US006634614B1

(12) United States Patent
Page

(10) Patent No.: US 6,634,614 B1
(45) Date of Patent: Oct. 21, 2003

(54) PORTABLE COMBINATION CLIPBOARD AND BOOK HOLDER

(76) Inventor: Je'Ron Lewis Page, 7001 Northline Dr., #205, Houston, TX (US) 75766

( * ) Notice: Subject to any disclaimer, the term of this patent is extended or adjusted under 35 U.S.C. 154(b) by 131 days.

(21) Appl. No.: 09/633,957

(22) Filed: Aug. 8, 2000

Related U.S. Application Data

(60) Provisional application No. 60/148,331, filed on Aug. 12, 1999.

(51) Int. Cl.[7] ..... A47B 97/04
(52) U.S. Cl. ..... 248/452; 248/454
(58) Field of Search ..... 248/452, 457, 248/454, 445, 462, 465

(56) References Cited

U.S. PATENT DOCUMENTS

| | | | | | |
|---|---|---|---|---|---|
| 822,691 | A | * | 6/1906 | Pashley | 248/452 |
| 2,492,034 | A | * | 12/1949 | Clyne | 240/6.4 |
| 4,329,799 | A | * | 5/1982 | Nagley | 40/352 |
| D321,012 | S | * | 10/1991 | Wright | D19/88 |
| 5,116,012 | A | * | 5/1992 | Offenhauer et al. | 248/452 |
| 5,150,873 | A | * | 9/1992 | Donovan | 248/460 |
| 5,180,133 | A | * | 1/1993 | Chang | 248/452 |
| 5,312,082 | A | * | 5/1994 | Chang | 248/452 |
| D356,339 | S | * | 3/1995 | Geborek | D19/88 |
| 5,732,925 | A | * | 3/1998 | Shamoon | 248/452 |
| 6,217,075 | B1 | * | 4/2001 | Tsai | 281/45 |

* cited by examiner

*Primary Examiner*—Leslie A. Braun
*Assistant Examiner*—A. Joseph Wujciak, III
(74) *Attorney, Agent, or Firm*—Kenneth A. Roddy

(57) ABSTRACT

A portable combination clipboard and book holder has a flat generally rectangular board with a hinged book support at one end connected by stop hinges to allow it to be pivoted between a horizontal stored position on the top surface of the board and an upright in-use position. The unhinged edge of the book support has a wide V-shaped configuration. A pair of generally rectangular transverse bars secured to the top surface of the board in laterally opposed spaced apart relation extend inwardly from the left and right sides of the board and a short distance vertically upward from the top surface of the board. When the book support is pivoted to its upright position, an opened book may be supported in a generally inclined position with the laterally opposed lower edges of its cover or pages engaged on the transverse bars and the exterior of its cover supported on the V-shaped edge and its spine disposed toward the apex portion of the V-shaped edge. A spring clip secured to the top surface of the board between the transverse bars is spring biased toward the top surface of the board to engage a sheet or pad of papers that may be supported on the top surface of the board. A second embodiment utilizes a single elongate transverse bar and has no spring clip. A third embodiment includes a pivotal extension that pivots outwardly from the V-shaped edge to increase the height of the book support and also serves as a latch for engaging a pad of papers supported on the top surface of the board.

8 Claims, 7 Drawing Sheets

PORTABLE COMBINATION CLIPBOARD AND BOOK HOLDER

This application claims the benefit of Provisional Application Ser. No. 60/148,331, filed Aug. 12, 1999.

BACKGROUND OF THE INVENTION

1. Field of the Invention

This invention relates generally to devices for holding papers and books for reading and writing devices, and more particularly to a combination clipboard and book holder for use in reading and writing.

SUMMARY OF THE INVENTION

A principal object of the present invention is to provide a combination clipboard and book holder for use by a person to facilitate reading and writing in a simple and relaxing way.

Another object of this invention is to provide a lightweight portable combination clipboard and book holder that can be easily transported to a school, library by hand or in a backpack.

Another object of this invention is to provide a combination clipboard and book holder which, in use, will allow a book to be positioned and maintained in an upright open position on the clipboard by simply raising a hinged book support member.

Another object of this invention is to provide a combination clipboard and book holder having a writing surface section on the board and a spring clip mounted on the board to secure sheets or pads of paper to the board, when in use or not in use.

A further object of this invention is to provide a combination clipboard and book holder having a transverse bar and a latching member that extends through a slot in the transverse bar to secure the a pad of paper to the clipboard surface.

A still further object of this invention is to provide a combination clipboard and book holder that is simple in construction, inexpensive to manufacture and is cost effective to the consumer.

Other objects of the invention will become apparent from time to time throughout the specification and claims as hereinafter related.

The above noted objects and other objects of the invention are accomplished by a portable combination clipboard and book holder having a flat generally rectangular board with a hinged book support at one end connected by stop hinges to allow it to be pivoted between a horizontal stored position on the top surface of the board and an upright in-use position. The unhinged edge of the book support has a wide V-shaped configuration. A pair of generally rectangular transverse bars secured to the top surface of the board in laterally opposed spaced apart relation extend inwardly from the left and right sides of the board and a short distance vertically upward from the top surface of the board. When the book support is pivoted to its upright position, an opened book may be supported in a generally inclined position with the laterally opposed lower edges of its cover or pages engaged on the transverse bars and the exterior of its cover supported on the V-shaped edge and its spine disposed toward the apex portion of the V-shaped edge. A spring clip secured to the top surface of the board between the transverse bars is spring biased toward the top surface of the board to engage a sheet or pad of papers that may be supported on the top surface of the board. A second embodiment utilizes a single elongate transverse bar and has no spring clip. A third embodiment includes a pivotal extension that pivots outwardly from the V-shaped edge to increase the height of the book support and also serves as a latch for engaging a pad of papers supported on the top surface of the board.

DETAILED DESCRIPTION OF THE PREFERRED EMBODIMENTS

Figure 1:
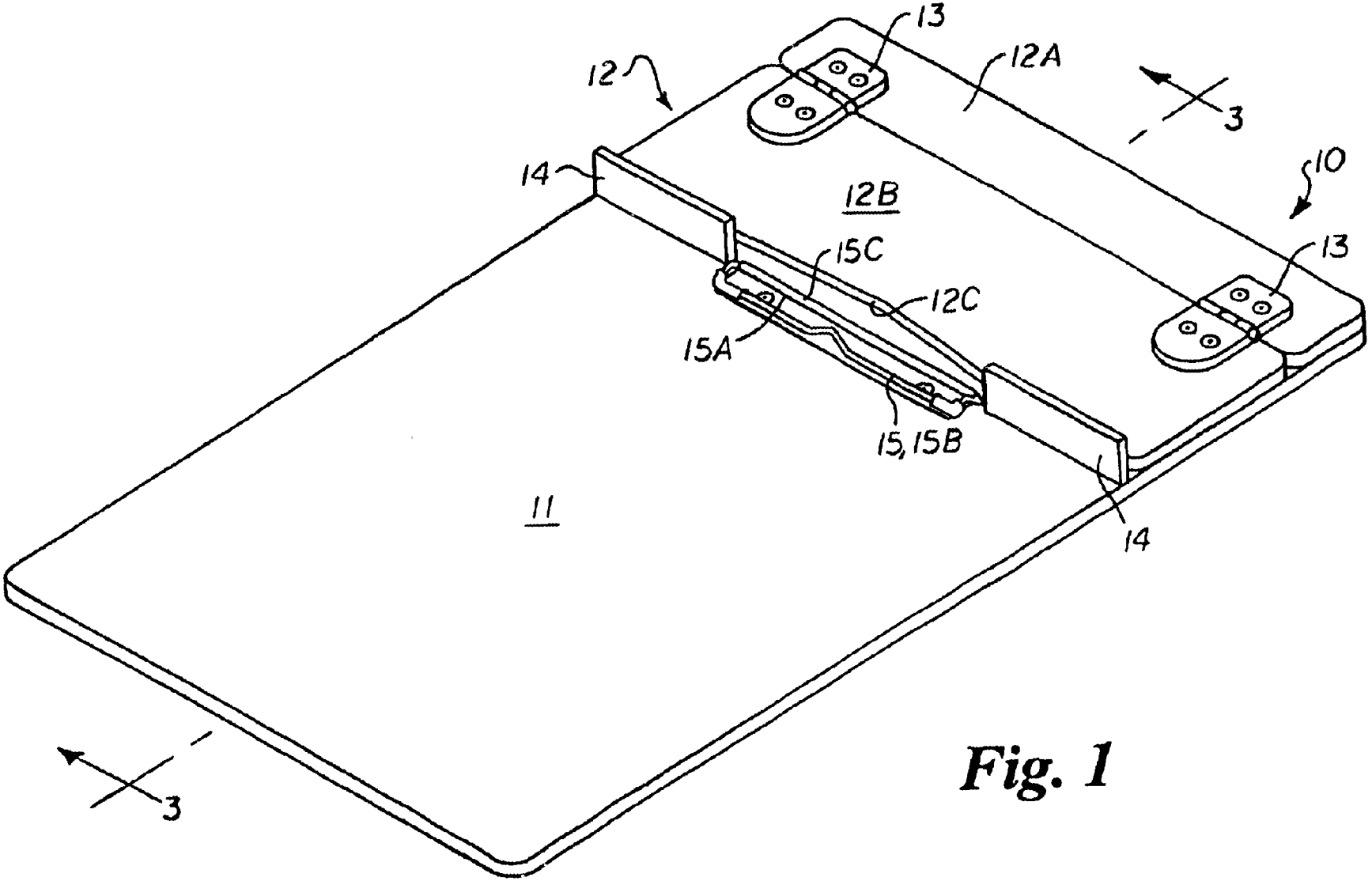
FIG. 1 is an isometric view of the combination clipboard and book holder in accordance with a first embodiment of the present invention, shown with the book holding member in a collapsed position.
Figure 2:
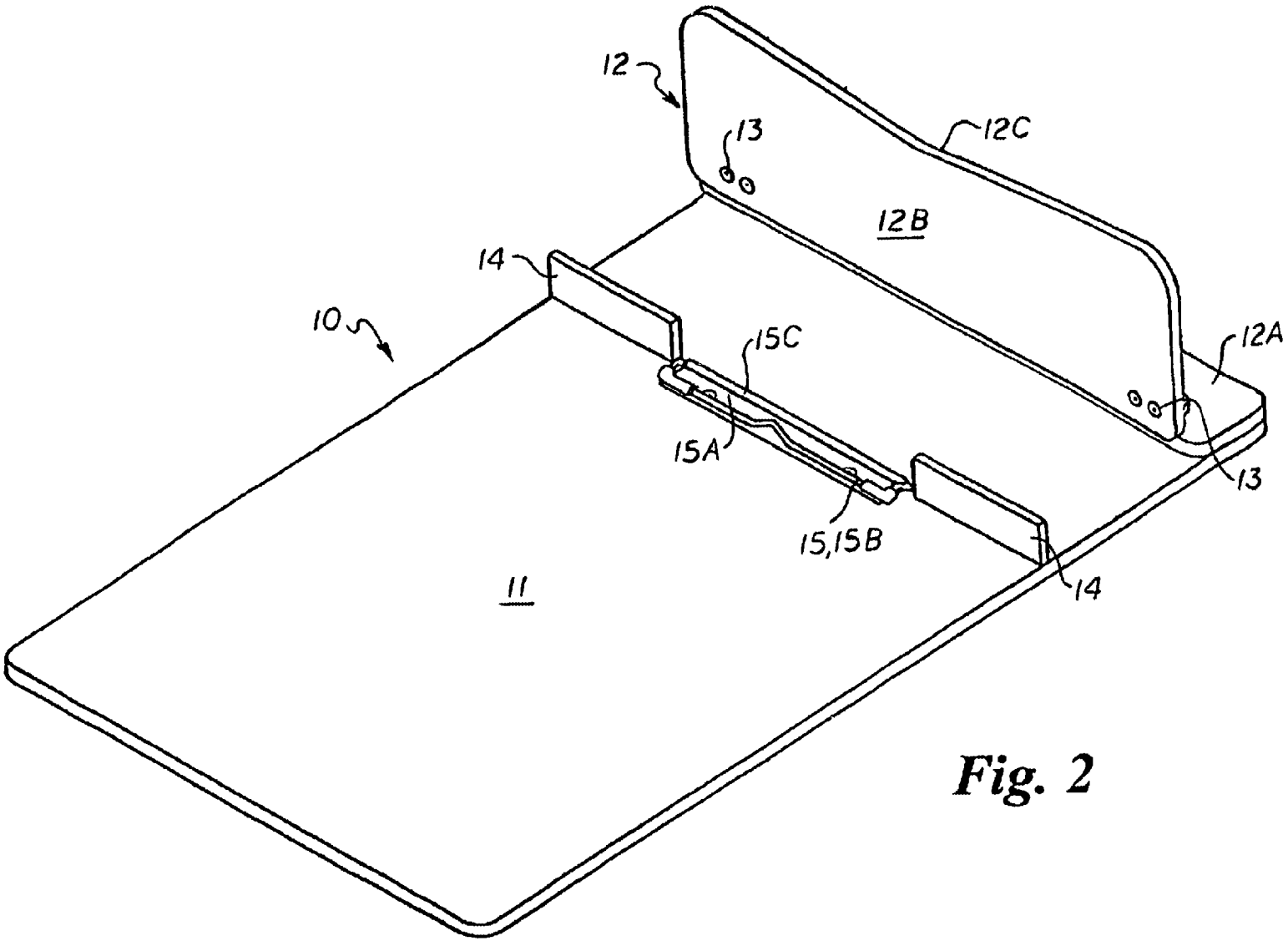
FIG. 2 is an isometric view of the combination clipboard and book holder of FIG. 1, shown with the book holding member in an upright raised position.
Figure 3:
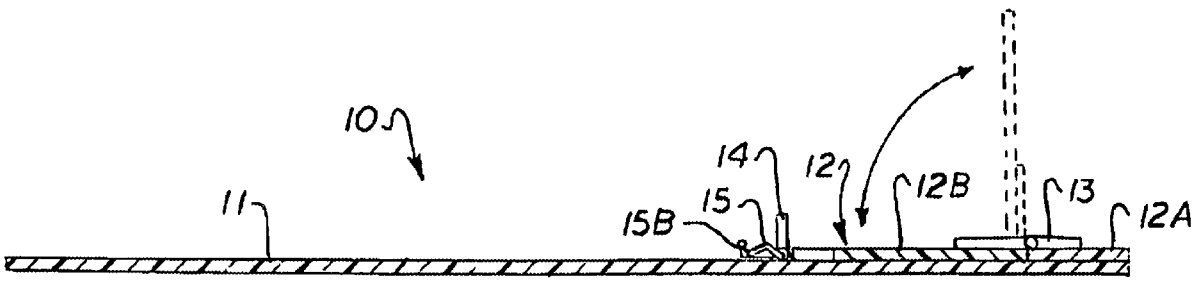
FIG. 3 is a longitudinal cross section through the combination clipboard and book holder, taken along line 3—3 of FIG. 1, and showing the book holding member in its upright position in dashed line.

Referring now to FIGS. 1–3, there is shown a first preferred embodiment of the portable combination clipboard and book holder 10 for use in reading and writing. The combination clipboard and book holder 10 includes a flat generally rectangular board 11 having a hinged book support member 12 at one end thereof. The book support 12 is of two-piece construction, having a first flat generally rectangular member 12A which is secured to the top surface of the board 11 at one end thereof, and a second flat generally rectangular member 12B which is hingedly connected to the first member by a pair of laterally spaced stop hinges 13. The unhinged edge of the second member 12B of the book support 12 is tapered inwardly from its lateral sides to form a wide V-shaped edge 12C. The stop hinges 13 allow the second member 12B of the book support 12 to be pivoted between a horizontal stored position on the top surface of the board 11 and an upright generally vertical in-use position.

A pair of generally rectangular transverse bars 14 are secured to the top surface of the board 11 in laterally opposed spaced apart relation in front of the V-shaped edge 12C of the second member 12B of the book support 12 in its horizontal stored position. The rectangular transverse bars 14 extend inwardly from the left and right sides of the board 11 and a short distance vertically upward from the top surface of the board. It should be understood from the foregoing, that when the second member 12B of the book support 12 is pivoted to its upright in-use position, an opened book may be supported in a generally inclined position with the laterally opposed lower edges of its cover or pages engaged on the transverse bars 14 and the exterior of its cover supported on the V-shaped edge 12C and its spine disposed toward the apex portion of the V-shaped edge.

A spring clip 15 has a base portion 15A secured to the top surface of the board 11 between the inward facing ends of the laterally opposed transverse bars 14 and a front portion 15B extending forwardly from the base portion which is spring biased downwardly toward the top surface of the board 11 by spring coils 15C to engage a sheet or pad of papers that may be supported on the top surface of the board. The rectangular transverse bars 14 serve as an upraised stop surface against which the top edge of the sheet or pad of papers supported on the top surface of the board may be engaged when the front portion 15B of the spring clip 15 is engaged thereon.

Figure 4:
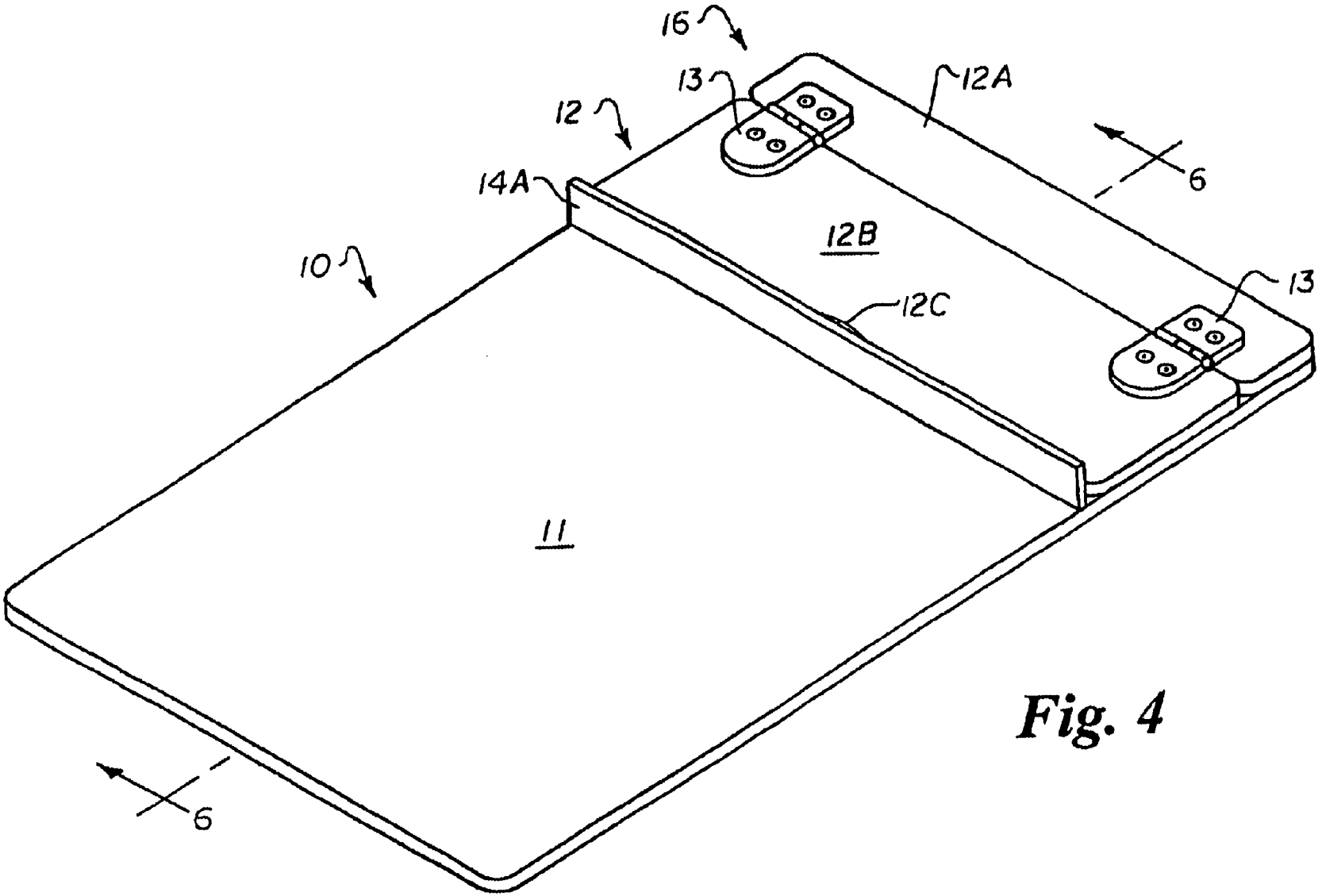
FIG. 4 is an isometric view of the combination clipboard and book holder in accordance with a second embodiment of the present invention, shown with the book holding member in a collapsed position.
Figure 5:
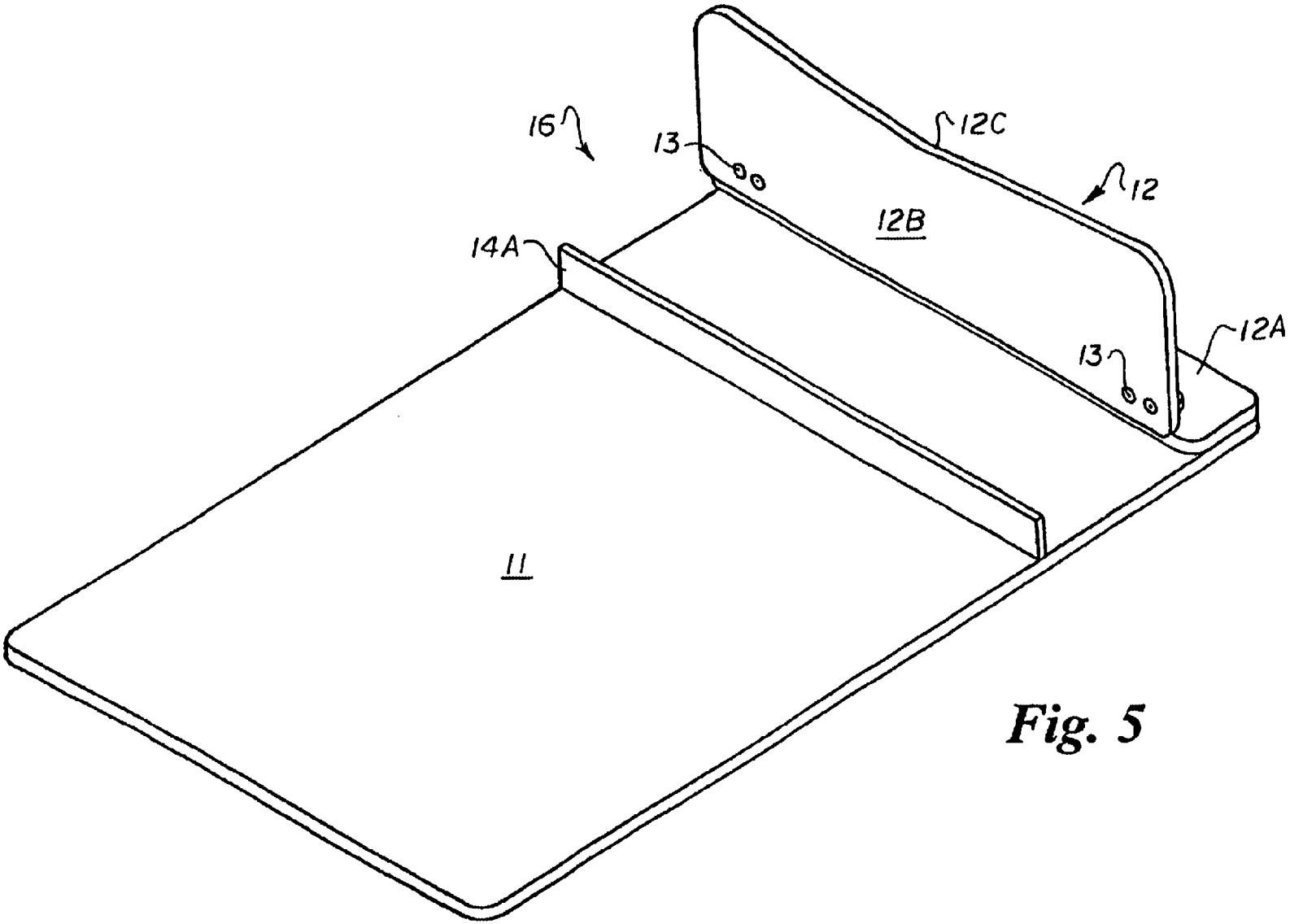
FIG. 5 is an isometric view of the combination clipboard and book holder of FIG. 4, shown with the book holding member in an upright raised position.
Figure 6:
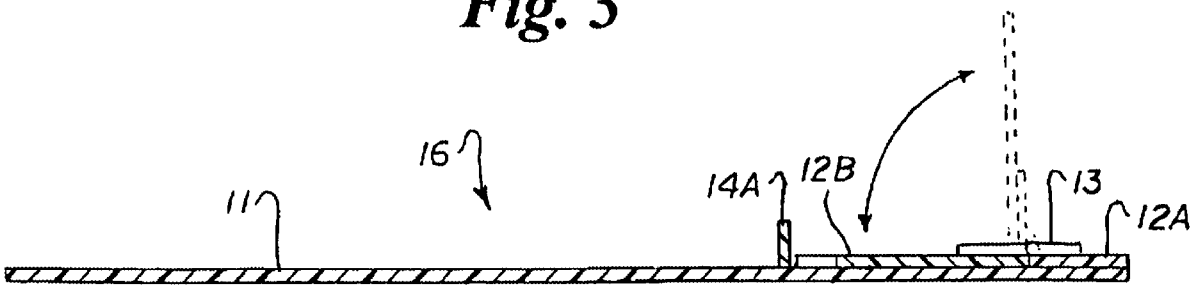
FIG. 6 is a longitudinal cross section through the combination clipboard and book holder, taken along line 6—6 of FIG. 4, and showing the book holding member in its upright position in dashed line.

Referring now to FIGS. 4–6, there is shown a second preferred embodiment of the portable combination clipboard and book holder 16 for use in reading and writing. The components which are the same as previously described above are given the same numerals of reference. The combination clipboard and document holder 16 includes a flat generally rectangular board 11 having a hinged book support member 12 at one end thereof. The book support 12 is of two-piece construction, having a first flat generally rectangular member 12A which is secured to the top surface of the board 11 at one end thereof, and a second flat generally rectangular member 12B which is hingedly connected to the first member by a pair of laterally spaced stop hinges 13. The unhinged edge of the second member 12B of the book support 12 is tapered inwardly from its lateral sides to form a wide V-shaped edge 12C. The stop hinges 13 allow the second member 12B of the book support 12 to be pivoted between a horizontal stored position on the top surface of the board 11 and an upright generally vertical in-use position.

In this embodiment a single generally rectangular transverse bar 14A is secured to the top surface of the board 11 in front of the V-shaped edge 12C of the second member 12B of the book support 12 in its horizontal stored position. The rectangular transverse bar 14A extends across the top surface of the board 11 from the left to the right side and a short distance vertically upward from the top surface of the board. It should be understood from the foregoing, that when the second member 12B of the book support 12 is pivoted to its upright in-use position, an opened book may be supported in a generally inclined position with the laterally opposed lower edges of its cover or pages engaged on the transverse bar 14A and the exterior of its cover supported on the V-shaped edge 12C and its spine disposed toward the apex portion of the V-shaped edge.

A sheet or pad of papers may be supported on the top surface of the board. The rectangular transverse bar 14A serves as an upraised stop surface against which the top edge of the sheet or pad of papers supported on the top surface of the board may be engaged.

Figure 9:
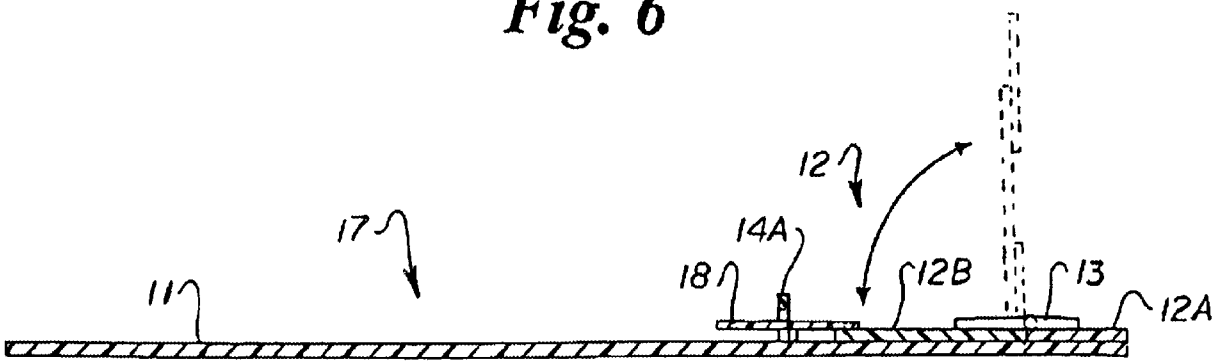
FIG. 9 is a longitudinal cross section through the combination clipboard and book holder, taken along line 9—9 of FIG. 7, and showing the book holding member in its upright position in dashed line.
Figure 7:
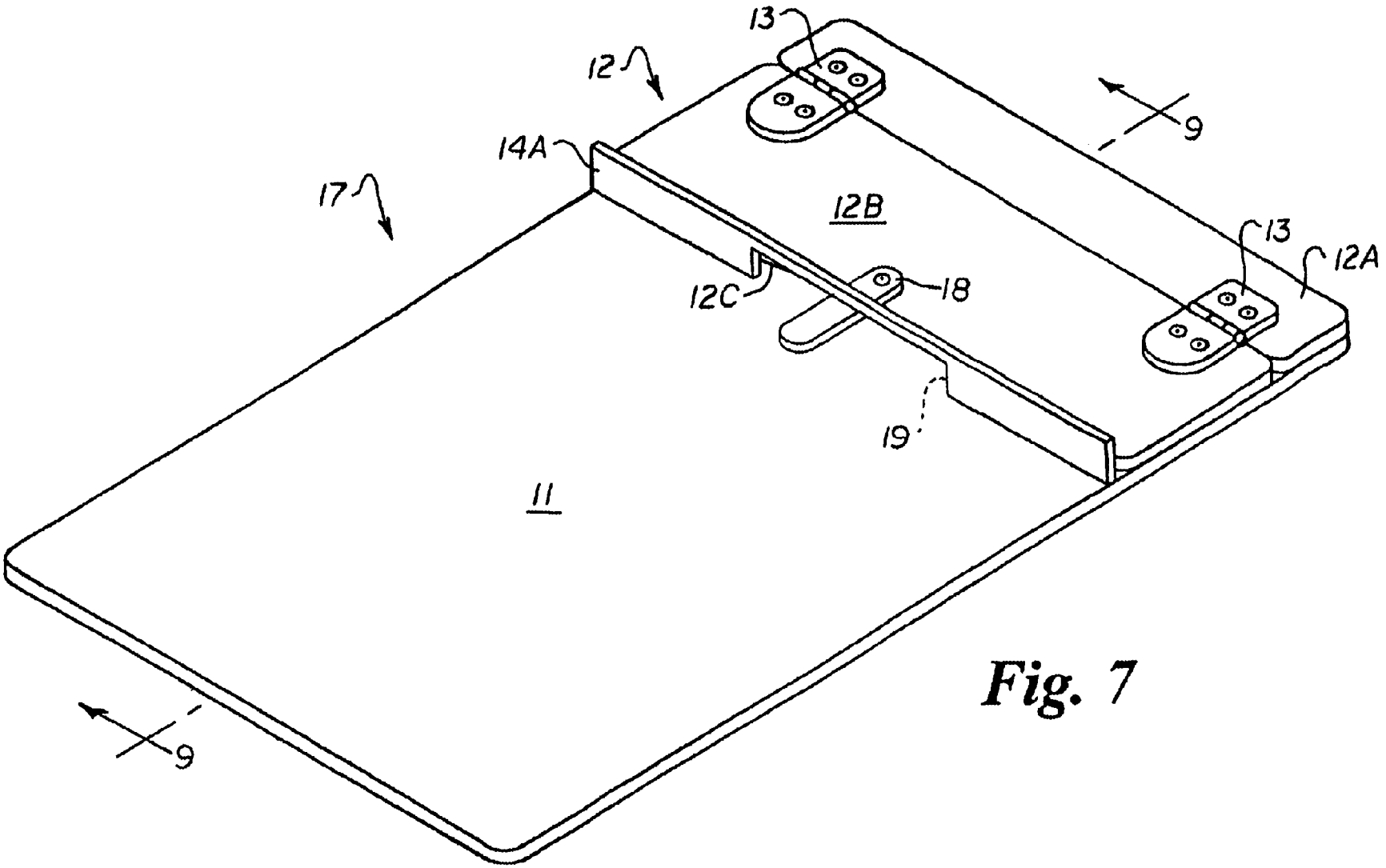
FIG. 7 is an isometric view of the combination clipboard and book holder in accordance with a third embodiment of the present invention, shown with the book holding member in a collapsed position.
Figure 8:
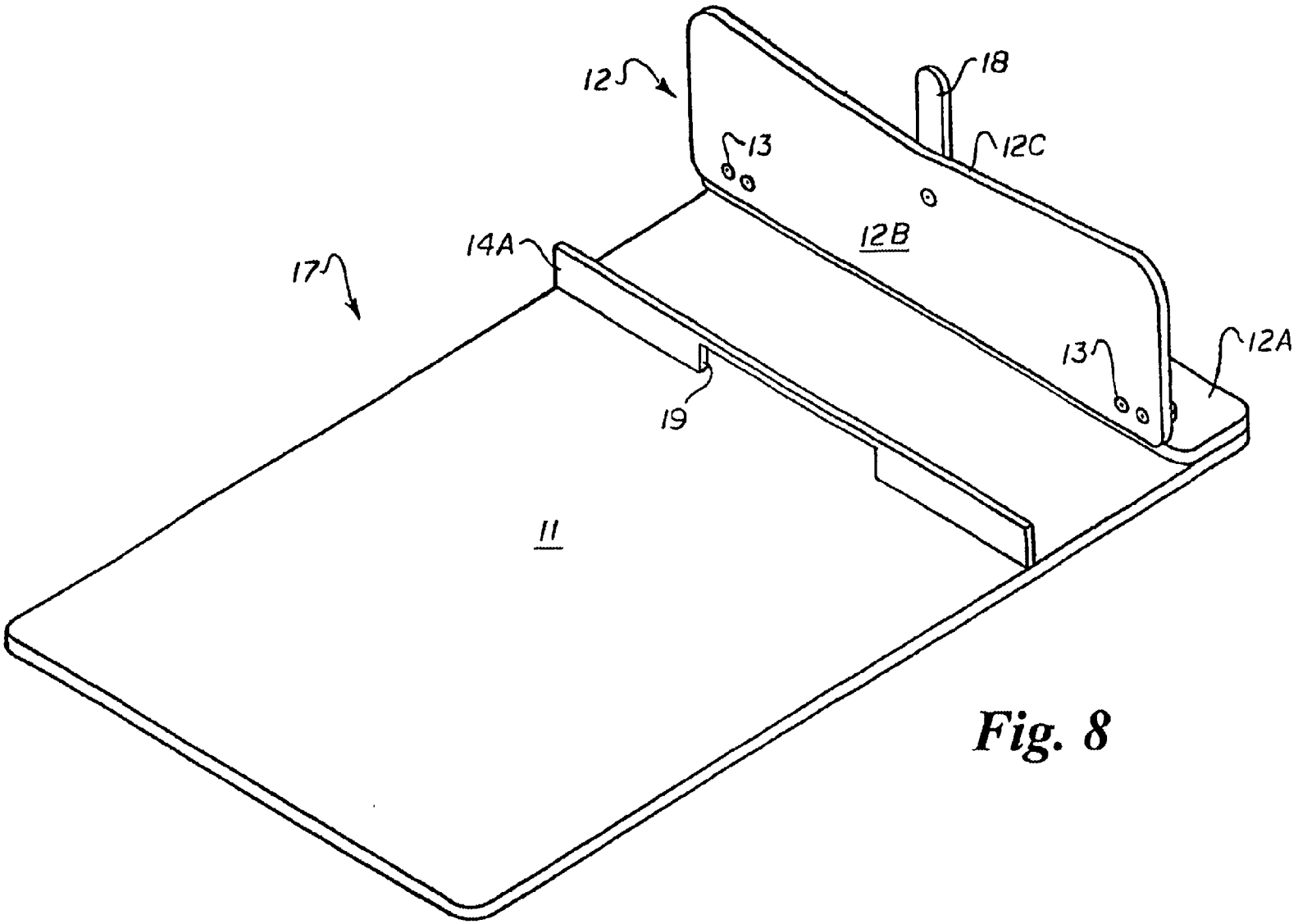
FIG. 8 is an isometric view of the combination clipboard and book holder of FIG. 7, shown with the book holding member in an upright raised position.

Referring now to FIGS. 7–9, there is shown a third preferred embodiment of the portable combination clipboard and book holder 17 for use in reading and writing. The components which are the same as previously described above are given the same numerals of reference. The combination clipboard and document holder 17 includes a flat generally rectangular board 11 having a hinged book support member 12 at one end thereof. The book support 12 is of two-piece construction, having a first flat generally rectangular member 12A which is secured to the top surface of the board 11 at one end thereof, and a second flat generally rectangular member 12B which is hingedly connected to the first member by a pair of laterally spaced stop hinges 13. The unhinged edge of the second member 12B of the book support 12 is tapered inwardly from its lateral sides to form a wide V-shaped edge 12C. The stop hinges 13 allow the second member 12B of the book support 12 to be pivoted between a horizontal stored position on the top surface of the board 11 and an upright generally vertical in-use position.

In this embodiment, a generally rectangular extension 18 is pivotally connected at one end to the top surface of the second member 12B of the book support 12 a distance inwardly from the apex of the V-shaped edge 12C. When the second member 12B of the book support 12 in its vertical in-use position, the free end of the extension 18 may be pivoted to extend outwardly beyond the V-shaped edge 12C of the second member 12B of the book support 12 to increase the height of the book support.

A single generally rectangular transverse bar 14A is secured to the top surface of the board 11 in front of the V-shaped edge 12C of the second member 12B of the book support 12 in its horizontal stored position. The rectangular transverse bar 14A extends across the top surface of the board 11 from the left to the right side and a short distance vertically upward from the top surface of the board. The center portion of the transverse bar 14A is provided with a longitudinal aperture or slot 19 extending therethrough. It should be understood from the foregoing, that when the second member 12B of the book support 12 is pivoted to its upright in-use position, an opened book may be supported in a generally inclined position with the laterally opposed lower edges of its cover or pages engaged on the transverse bar 14A and the exterior of its cover supported on the V-shaped edge 12C and its spine disposed toward the apex portion of the V-shaped edge. The free end of the extension 18 may be pivoted to extend outwardly beyond the V-shaped edge 12C of the second member 12B of the book support 12 to increase the height of the book support if needed.

A pad of papers may be supported on the top surface of the board. The rectangular transverse bar 14A serves as an upraised stop surface against which the top edge of the pad of papers supported on the top surface of the board may be engaged.

When the second member 12B of the book support 12 is pivoted to its horizontal stored position on the top surface of the board 11, the free end of the extension 18 may be pivoted to extend outwardly beyond the V-shaped edge 12C of the second member 12B of the book support 12 and through the slot 19 in the transverse bar 14A to engage and releasably hold the pad of papers that may be supported on the top surface of the board.

While this invention has been described fully and completely with special emphasis upon preferred embodiments, it should be understood that within the scope of the appended claims the invention may be practiced otherwise than as specifically described herein.

What is claimed is:

1. A portable combination clipboard and book holder for use in reading and writing, comprising:

a flat generally rectangular board having a top surface;

a flat generally rectangular book support member hingedly connected at one end of said board by stop hinge means to allow said book support member to be pivoted between a horizontal stored position on said top surface of said board and an upright generally vertical in-use position;

a pair of generally rectangular transverse bars secured to said top surface of said board adjacent to an unhinged end of said book support member in its horizontal stored position, said transverse bars extending a distance inwardly from lateral sides of said board in laterally opposed relation, and a short distance vertically upward from said top surface of said board;

a spring clip having a base portion secured to said top surface of said board between inward facing ends of said laterally opposed transverse bars and a front portion extending forwardly therefrom spring biased downwardly toward said top surface to engage a sheet or pad of papers supported on said top surface;

said transverse bars serving as a raised stop surface against which a top edge of the sheet or pad of papers supported on said top surface of said board may be engaged; and said book support member, when pivoted to its said upright in-use position, disposed to receive and support an opened book, and said transverse bar disposed to engage and support laterally opposed lower edges of the book cover or pages such that the opened book is supported in an upright inclined position.

2. The portable combination clipboard and book holder according to claim 1, wherein said unhinged edge of said book support member is tapered inwardly from lateral sides thereof to form a wide V-shaped edge; and when said book support member is pivoted to its said upright in-use position, said V-shaped edge is disposed to receive and support the opened book with its spine positioned toward the apex portion of the V-shaped edge.

3. The portable combination clipboard and book holder according to claim 1, wherein said book support member is of two-piece construction, comprising a first flat generally rectangular member secured to said top surface of said board at one end thereof, and a second flat generally rectangular member hingedly connected to said first member by a pair of laterally spaced stop hinges that allow said second flat generally rectangular member to be pivoted between said horizontal stored position on said top surface of said board and an upright generally vertical in-use position.

4. A portable combination clipboard and book holder for use in reading and writing, comprising:

a flat generally rectangular board having a top surface;

a flat generally rectangular book support member hingedly connected at one end of said board by stop hinge means to allow said book support member to be pivoted between a horizontal stored position on said top surface of said board and an upright generally vertical in-use position;

a generally rectangular transverse bar secured to said top surface of said board adjacent to an unhinged end of said book support member in its horizontal stored position, said transverse bar extending transversely between lateral sides of said board and a short distance vertically upward from said top surface of said board;

said unhinged edge of said book support member tapered inwardly from lateral sides thereof to form a wide V-shaped edge;

said book support member, when pivoted to its said upright in-use position, disposed to receive and support an opened book, said V-shaped edge disposed to receive and support the opened book with its spine positioned toward the apex portion of the V-shaped edge, and said transverse bar disposed to engage and support laterally opposed lower edges of the book cover or pages such that the opened book is supported in an upright inclined position; and said transverse bar also serving as a raised stop surface against which a top edge of a sheet or pad of papers supported on said top surface of said board may be engaged.

5. A portable combination clipboard and book holder for use in reading and writing, comprising:

a flat generally rectangular board having a top surface;

a flat generally rectangular book support member of two-piece construction, comprising a first flat generally rectangular member secured to said top surface of said board at one end thereof, and a second flat generally rectangular member hingedly connected to said first member by a pair of laterally spaced stop hinges that allow said second flat generally rectangular member to be pivoted between a horizontal stored position on said top surface of said board and an upright generally vertical in-use position;

a generally rectangular transverse bar secured to said top surface of said board adjacent to an unhinged end of said second flat generally rectangular member in its horizontal stored position, said transverse bar extending transversely between lateral sides of said board and a short distance vertically upward from said top surface of said board;

said second flat generally rectangular member, when pivoted to its said upright in-use position, disposed to receive and support an opened book and said transverse bar disposed to engage and support laterally opposed lower edges of the book cover or pages such that the opened book is supported in an upright inclined position; and said transverse bar also serving as a raised stop surface against which a top edge of a sheet or pad of papers supported on said top surface of said board may be engaged.

6. A portable combination clipboard and book holder for use in reading and writing, comprising:

a flat generally rectangular board having a top surface;

a flat generally rectangular book support member hingedly connected at one end of said board by stop hinge means to allow said book support member to be pivoted between a horizontal stored position on said top surface of said board and an upright generally vertical in-use position;

a narrow generally rectangular extension pivotally connected at one end to said book support member near an unhinged end thereof and having a free end pivotal between a stored position retracted from said unhinged end and an extended position projecting a distance beyond said unhinged end;

a generally rectangular transverse bar secured to said top surface of said board adjacent to an unhinged end of said book support member in its horizontal stored position, said transverse bar extending transversely between lateral sides of said board and a short distance vertically upward from said top surface of said board, and having a central longitudinal slot extending therethrough sized to receive said free end of said extension;

said book support member, when pivoted to its said upright in-use position, disposed to receive and support an opened book and said transverse bar disposed to engage and support laterally opposed lower edges of the book cover or pages such that the opened book is supported in an upright inclined position;

said extension, when pivoted to its said extended position projecting a distance beyond said unhinged end to increase the height of said book support;

said transverse bar serving as a raised stop surface against which a top edge of a sheet or pad of papers supported on said top surface of said board may be engaged; and when said book support member is pivoted to its said horizontal stored position on said top surface of said board, said extension being pivoted to its said extended position projecting a distance beyond said unhinged end and through said longitudinal slot to releasably engage a pad of papers supported on said top surface and maintain them thereon.

7. The portable combination clipboard and book holder according to claim 6, wherein said unhinged edge of said book support member is tapered inwardly from lateral sides thereof to form a wide V-shaped edge; and when said book support member is pivoted to its said upright in-use position, said V-shaped edge is disposed to receive and support the opened book with its spine positioned toward the apex portion of the V-shaped edge.

8. The portable combination clipboard and book holder according to claim 6, wherein said book support member is of two-piecem construction, comprising a first flat generally rectangular member secured to said top surface of said board at one end thereof, and a second flat generally rectangular member hingedly connected to said first member by a pair of laterally spaced stop hinges that allow said second flat generally rectangular member to be pivoted between said horizontal stored position on said top surface of said bpard and an upright generally vertical in-use position.

* * * * *